US010389044B2

(12) United States Patent
Takeuchi et al.

(10) Patent No.: US 10,389,044 B2
(45) Date of Patent: Aug. 20, 2019

(54) CONNECTOR

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Shunya Takeuchi, Mie (JP); Yasuo Omori, Mie (JP); Hajime Matsui, Mie (JP); Takehiro Nakata, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 15/767,183

(22) PCT Filed: Oct. 3, 2016

(86) PCT No.: PCT/JP2016/079365
§ 371 (c)(1),
(2) Date: Apr. 10, 2018

(87) PCT Pub. No.: WO2017/065044
PCT Pub. Date: Apr. 20, 2017

(65) Prior Publication Data

US 2018/0301827 A1 Oct. 18, 2018

(30) Foreign Application Priority Data

Oct. 12, 2015 (JP) ..... 2015-201649

(51) Int. Cl.
*H01R 4/70* (2006.01)
*H01R 13/42* (2006.01)
(Continued)

(52) U.S. Cl.
CPC ..... *H01R 4/70* (2013.01); *H01R 4/184* (2013.01); *H01R 4/185* (2013.01); *H01R 13/42* (2013.01);
(Continued)

(58) Field of Classification Search
CPC ..... H01R 4/70; H01R 4/184; H01R 4/185; H01R 13/42; H01R 13/52; H01R 13/5205; H01R 13/5216
See application file for complete search history.

(56) References Cited

U.S. PATENT DOCUMENTS 7,717,733 B1 * 5/2010 Yi ..... H01R 13/58 439/452
8,864,533 B2 * 10/2014 Morikawa ..... H01R 4/62 439/595
(Continued)

FOREIGN PATENT DOCUMENTS

JP 64-84580 3/1989
JP 2012-3856 1/2012
(Continued)

OTHER PUBLICATIONS

International Search Report dated Dec. 20, 2016.

*Primary Examiner* — Dhiru R Patel
(74) *Attorney, Agent, or Firm* — Gerald E. Hespos; Michael J. Porco; Matthew T. Hespos

(57) ABSTRACT

A connector includes barrels (19) formed in rear end parts of terminal fittings (15) and crimped to surround front end parts of coated wires (11). First to third molds (23A, 23B, 23C) each covering the front end part of the coated wire (11) including a crimped part to the barrel (19) in a liquid-tight manner. A housing (30) is formed with terminal accommodation chambers (31) each for accommodating the entire terminal fitting (15) and a front end area of the mold (23A, 23B, 23C), and first to third contacts (26A, 26B, 26C) each
(Continued)

formed on a projection (25) of the mold (23A, 23B, 23C) projecting out from the housing (30) and configured to suppress deformation of the projection (25) of the mold (23A, 23B, 23C) by coming into contact with the housing (30).

3 Claims, 13 Drawing Sheets

(51) Int. Cl.
*H01R 4/18* (2006.01)
*H01R 13/52* (2006.01)

(52) U.S. Cl.
CPC ..... *H01R 13/52* (2013.01); *H01R 13/5205* (2013.01); *H01R 13/5216* (2013.01)

(56) References Cited

U.S. PATENT DOCUMENTS

| | | | |
|---|---|---|---|
| 9,190,743 | B2 | 11/2015 | Sato et al. |
| 2014/0194002 | A1 | 7/2014 | Sato |

FOREIGN PATENT DOCUMENTS

| | | |
|---|---|---|
| JP | 2012-84407 | 4/2012 |
| JP | 2013-45576 | 3/2013 |

* cited by examiner

CONNECTOR

BACKGROUND

Field of the Invention

The present invention relates to a connector.

Description of the Related Art

Japanese Unexamined Patent Publication No. 2012-003856 discloses a technique for anti-corrosion by crimping and connecting a barrel portion of a terminal fitting made of copper to a front end part of a coated wire, in which a core made of aluminum is surrounded by an insulated coating. A contact part of the core and the terminal fitting then is surrounded in a liquid-tight manner by a mold portion made of synthetic resin. The mold portion covers up to a front end part of the insulation coating behind the terminal fitting.

Miniaturization is required in the field of connectors. To meet this demand, the mold portion needs to be thinned and reduced in diameter. However, if the mold portion is thinned, the bending of the coated wire affects a crimped part of the terminal fitting and the core so that contact reliability may be reduced.

The present invention was completed on the basis of the above situation and aims to enhance bending rigidity of a mold portion.

SUMMARY

The invention is directed to a connector with a coated wire including a core and an insulation coating surrounding the core. The core is exposed in a front end part. The connector also has a terminal fitting with a barrel formed in a rear end part of the terminal fitting. The barrel is crimped to surround the front end part of the coated wire. A mold covers the front end part of the coated wire in a liquid-tight manner including a part having the barrel crimped thereto. The connector further has a housing formed with a terminal accommodation chamber for accommodating the entire terminal fitting and a front end area of the mold portion. A contact portion is formed in the mold and is configured to suppress deformation of a projection of the mold projecting out from the housing by coming into contact with the housing.

According to this configuration the projection is less likely to be deformed by bringing the contact portion of the mold into contact with the housing. Thus, the influence of bending of the coated wire on a connected part of the terminal fitting and the core can be suppressed.

The housing may be formed with a plurality of the terminal accommodating chambers arranged in parallel for receiving a corresponding plurality of terminal fittings. The contact portion of each of the terminal fittings is in contact with an inner wall of the terminal accommodating chamber where the terminal fitting is not accommodated. According to this configuration, the rigidity of the mold can be enhanced even without changing the shape of the housing.

The contact portion may be in contact with an outer surface of the housing. According to this configuration, the rigidity of the mold portion can be enhanced even without changing or complicating the outer surface shape of the housing.

DETAILED DESCRIPTION

A specific embodiment of the invention is described with reference to FIGS. 1 to 13. In the following description, a right side in FIGS. 3, 4, 6 and 8 is defined as a front side concerning a front-rear direction. Upper and lower sides shown in FIGS. 2, 4, 6 and 8 are directly defined as upper and lower sides concerning a vertical direction. A connector of this embodiment includes three types of wires with terminals 10A, 10B and 10C and a housing 30.

Figure 4:
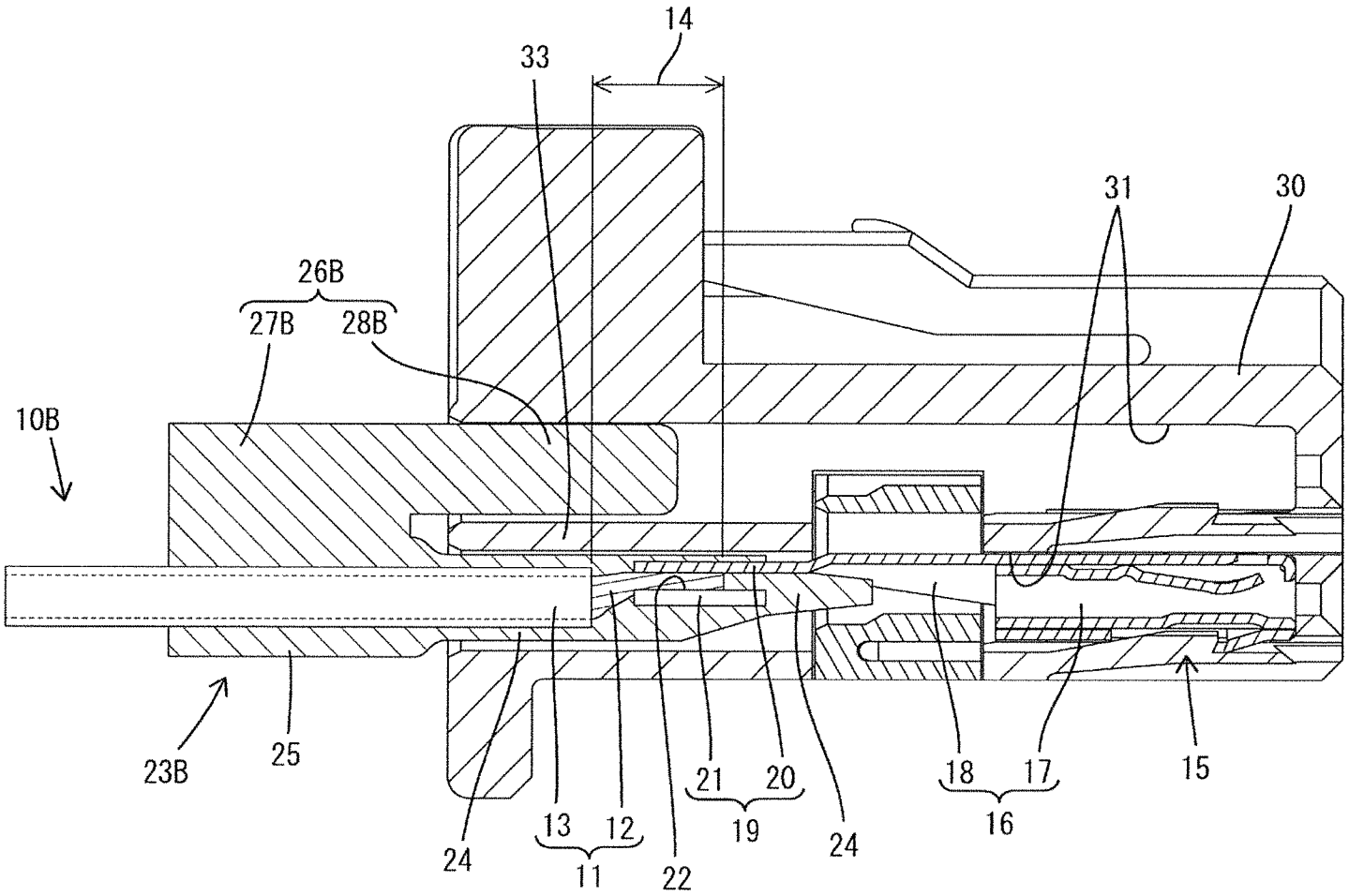
FIG. 4 is a section along Y-Y of FIG. 2.

As shown in FIG. 4, any of the three types of wires with terminals 10A, 10B and 10C is an integral assembly of a coated wire 11, a terminal fitting 15 and one of three types of molds 23A, 23B and 23C and constitutes a conductive path that is long and narrow in the front-rear direction. The coated wire 11 is a member common to the three types of wires with terminals 10A, 10B and 10C and is composed of a core 12 made of aluminum or aluminum alloy and a substantially hollow cylindrical insulation coating 13 surrounding the core 12. The insulation coating 13 is stripped by a predetermined length in a front end part of the coated wire 11 to expose the core 12. The terminal fitting 15 to be described later is crimped and connected to a front end part of an exposed area 14 of this core 12.

Figure 11:
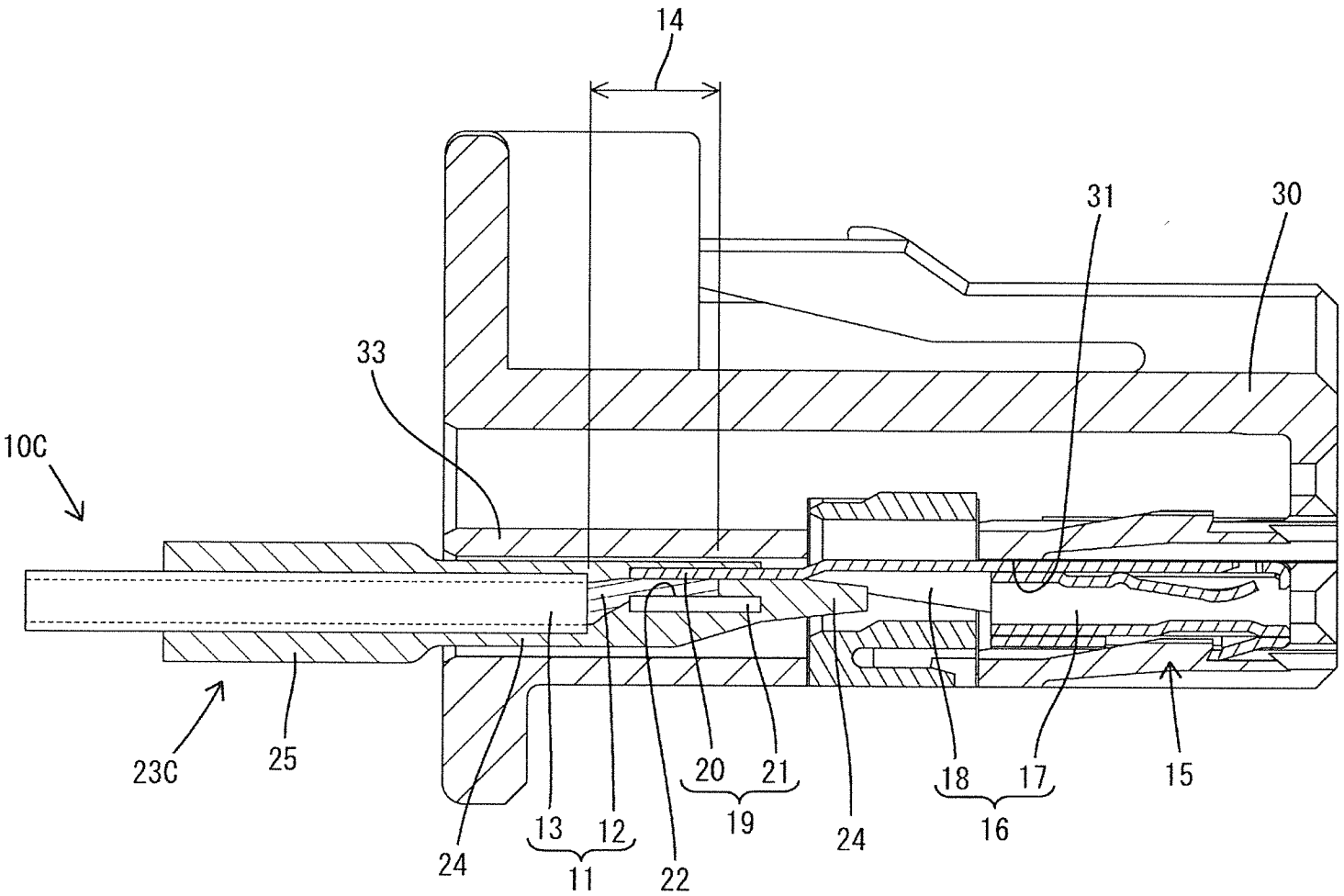
FIG. 11 is a section along Z-Z of FIG. 10.

The terminal fitting 15 also is a component common to the three types of wires with terminals 10A, 10B and 10C. The terminal fitting 15 is formed by applying bending and the like to a plate material made of copper or copper alloy stamped into a predetermined shape and shaped to be long and narrow in the front-rear direction. As shown in FIGS. 4 and 11, the terminal fitting 15 is composed of a terminal body 16 constituting a front area of the terminal fitting 15 and a barrel 19 constituting a rear area. The terminal body 16 is composed of a box-shaped connecting portion 17 having a rectangular tube shape and a coupling 18 connected to the rear end of the box-shaped connecting portion 17. A tab of a mating male terminal (not shown) is inserted into the box-shaped connecting portion 17 from the front of the terminal fitting 15 to be connected. The coupling 18 has a known form in which two side walls rise from both left and right sides of a bottom wall.

The barrel 19 is a known crimping means composed of a long and narrow base plate 20 extending rearward from the rear end of the coupling 18 and two crimping pieces 21 extending in a circumferential direction (direction intersecting a length direction of the terminal fitting 15) from both sides of the base plate 20 in a width direction. The barrel 19 is crimped to the front part of the coated wire 11 (core 12)

by an automatic machine called an applicator. In a crimping process, the crimping pieces 21 are bent and deformed to surround the front part of the core 12 placed on a rear end part of the base plate 20.

The bending and deformation of the crimping pieces 21 forms a crimping space 22 surrounded by the base plate 20 and the crimping pieces 21 of the barrel 19. A front end part of the core 12 and the terminal fitting 15 are fixed conductively in this crimping space 22 and are connected substantially straight. The core 12 is accommodated only in a rear end part of the crimping space 22 of the barrel 19, and a part of the mold 23A, 23B, 23C to be described later is filled in an area of the crimping space 22 before the core 12.

Any of the three types of first to third molds 23A, 23B and 23C is molded by a mold cavity (not shown) after the terminal fitting 15 is crimped to the core 12. The mold 23A, 23B, 23C is molded by accommodating the entire barrel 19, a rear end part of the coupling 18 and the front end part of the insulation coating 13 of the coated wire 11 into the known mold cavity, injecting molten resin (not shown) into the mold cavity and solidifying (curing) the injected molten resin. In a molding process, part of the molten resin flows into the crimping space 22 of the barrel 19.

Figure 3:
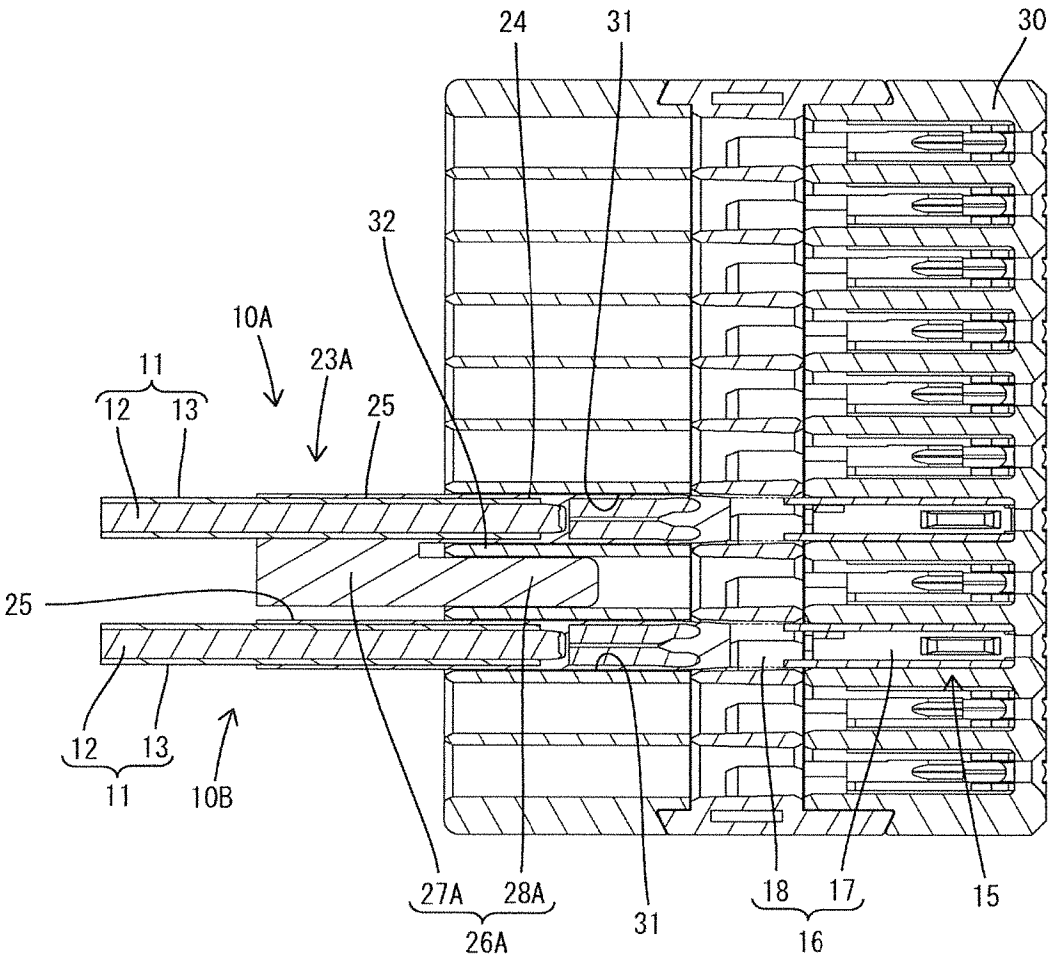
FIG. 3 is a section along X-X of FIG. 2.

As shown in FIGS. 3 and 11, the mold 23A, 23B, 23C after molding surrounds the entire barrel 19, the entire exposed area 14 of the core 12 including the crimped part to the barrel 19 and a front end part of an area of the coated wire 11 where the insulation coating 13 remains over the entire periphery in a liquid-tight manner. Further, a part of the front end part of the mold 23A, 23B, 23C is accommodated inside the coupling 18 before the barrel 19. The lower surface (outer surface) of an area of the mold 23A, 23B, 23C covering the barrel 19 is substantially at the same height as the lower surface (outer surface) of the terminal body 16. The wire with terminal 10A, 10B, 10C is inserted into a terminal accommodation chamber 31 from behind the housing 30. In an inserted state, the entire terminal fitting 15, the entire exposed area 14 of the core 12 and the front part of the insulation coating 13 are accommodated in the terminal accommodation chamber 31.

As shown in FIGS. 5 to 8, 12 and 13, the mold 23A, 23B, 23C includes an accommodating portion 24, a projection 25 and any one of first to third contact portions 26A, 26B and 26C. The accommodating portion 24 surrounds the entire terminal fitting 15, the entire exposed area 14 of the core 12 and the front part of the insulation coating 13 in a liquid-tight manner, and is accommodated in the terminal accommodation chamber 31 with the wire with terminal 10A, 10B, 10C mounted in the housing 30. The projection 25 is connected to the rear end of the accommodating portion 24 and surrounds the insulation coating 13 in a liquid-tight manner, and is exposed to outside behind the terminal accommodation chamber 31 (housing 30) with the wire with terminal 10A, 10B, 10C mounted in the housing 30.

The accommodating portion 24 and the projection 25 have common shapes in the first to third wires with terminals 10A, 10B and 10C. On the other hand, the first to third contact portions 26A, 26B and 26C formed on the projections 25 of the first to third mold portions 23A, 23B and 23C are shaped differently among the three types of first to third wires with terminals 10A, 10B and 10C.

Figure 5:
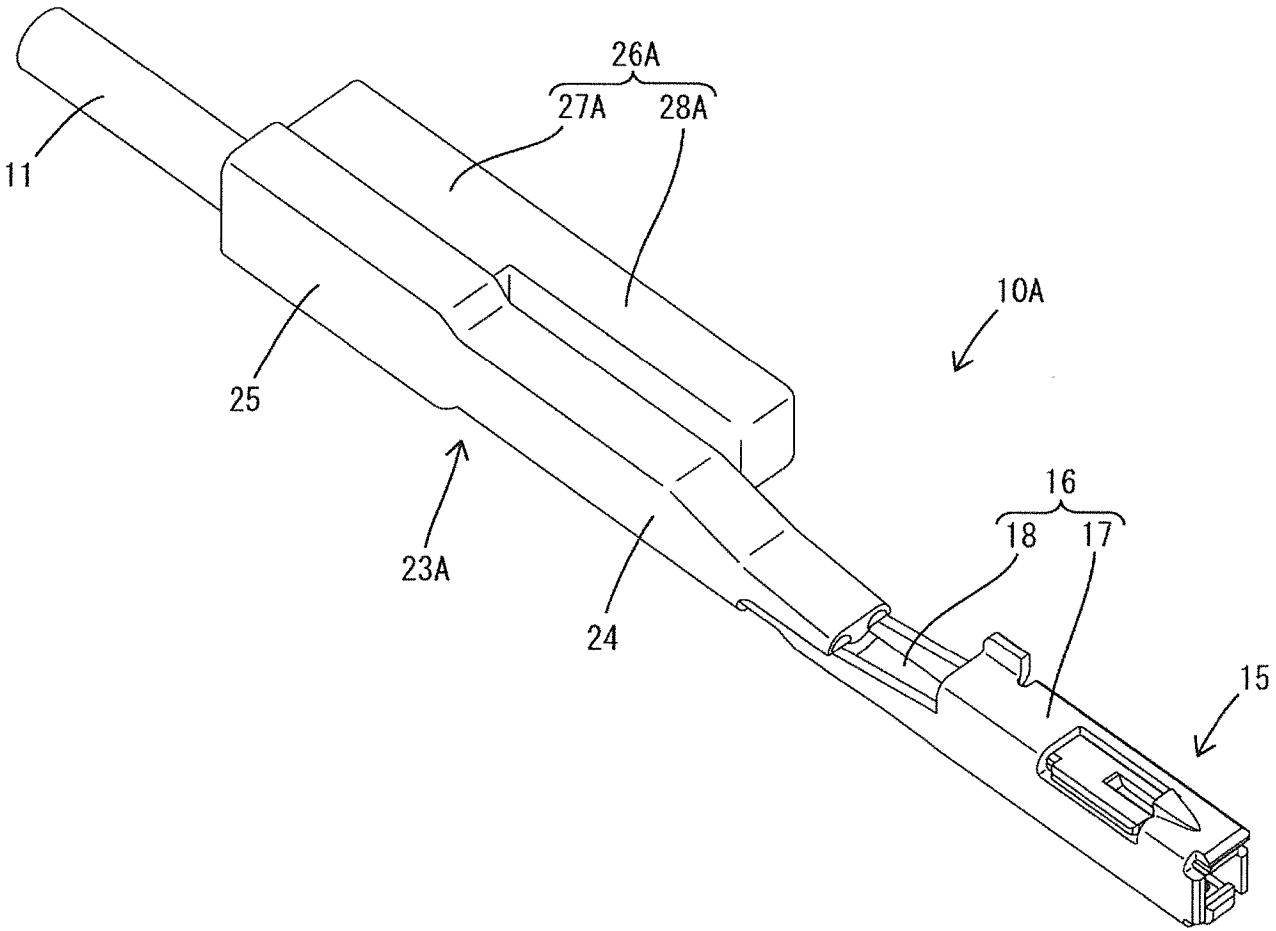
FIG. 5 is a perspective view of the first wire with terminal.
Figure 6:
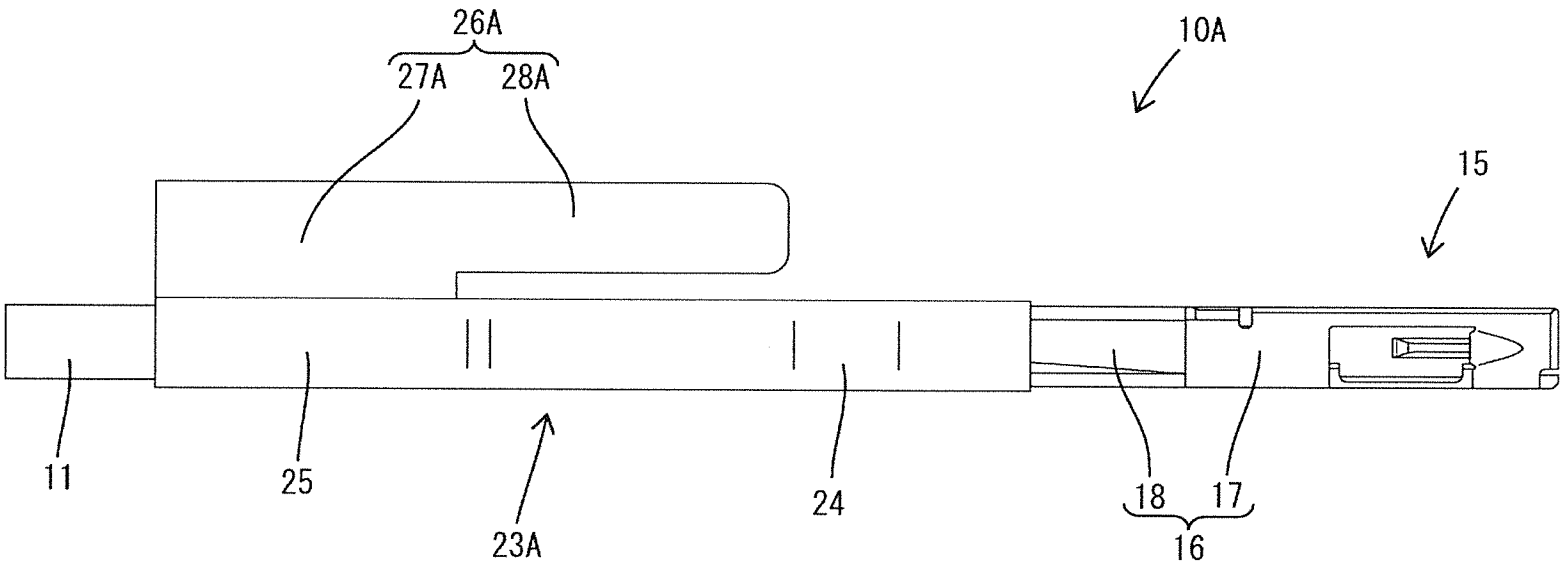
FIG. 6 is a plan view of the first wire with terminal.

As shown in FIGS. 5 and 6, the first contact portion 26A of the first mold 23A) constituting the first wire with terminal 10A is composed of a first bulge 27A and a first fitting 28A. The first bulge 27A is in the form of a rib (or wall) protruding leftward from the left side surface of the projection 25. A formation area of the first bulge 27A in the front-rear direction is a range continuous over the entire length of the projection 25 from a front end to a rear end. The first fitting 28A is cantilevered forward from the front end of the first bulge 27A. As shown in FIG. 3, a clearance equivalent to a thickness of a separation wall 32 between laterally adjacent terminal accommodation chambers 31 is formed between the right side surface of the first fitting 28A and the left side surface of the accommodating portion 24. The first fitting 28A is molded into a shape to fit into the terminal accommodation chamber 31 without rattling in the vertical direction and the lateral direction.

Figure 7:
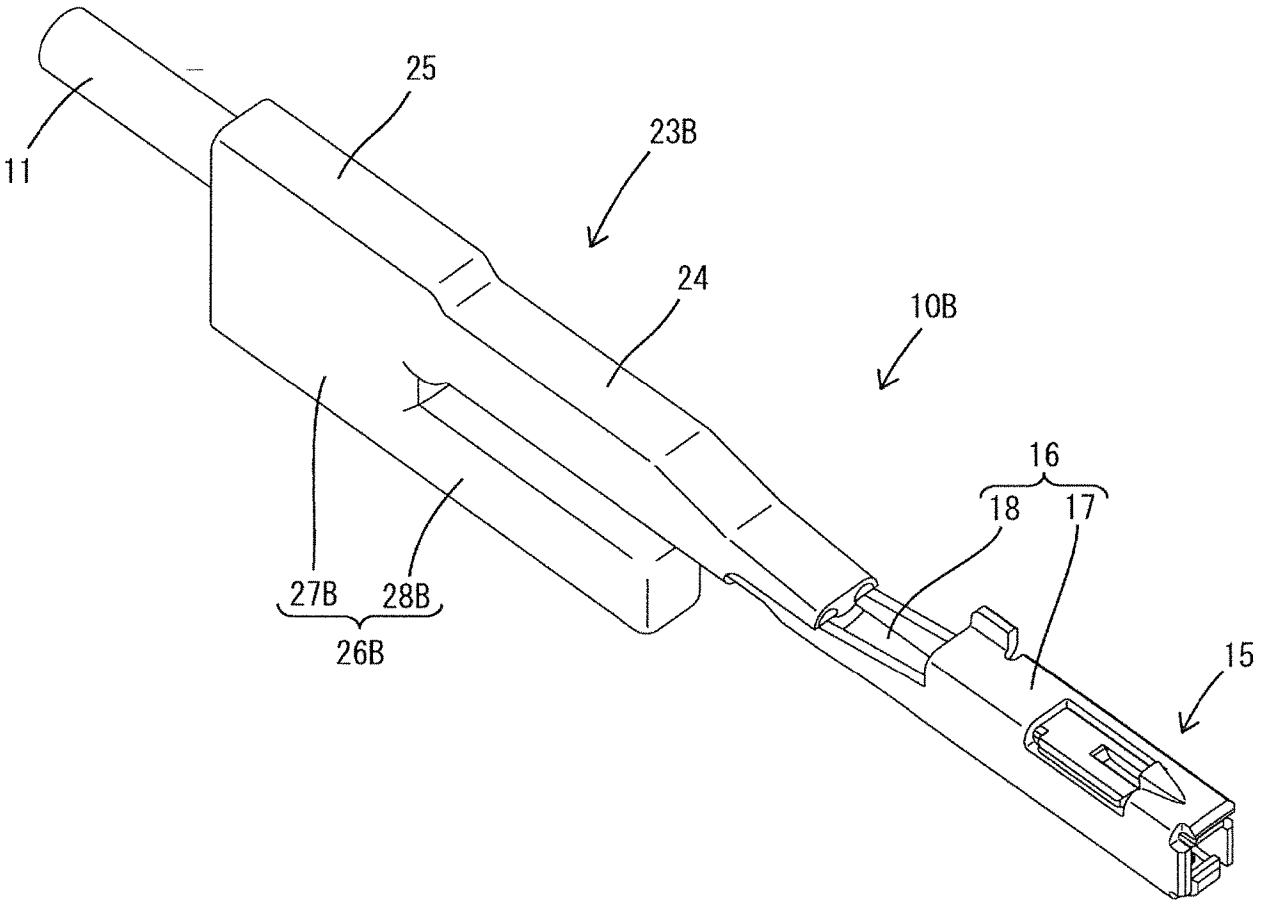
FIG. 7 is a perspective view of the second wire with terminal.
Figure 8:
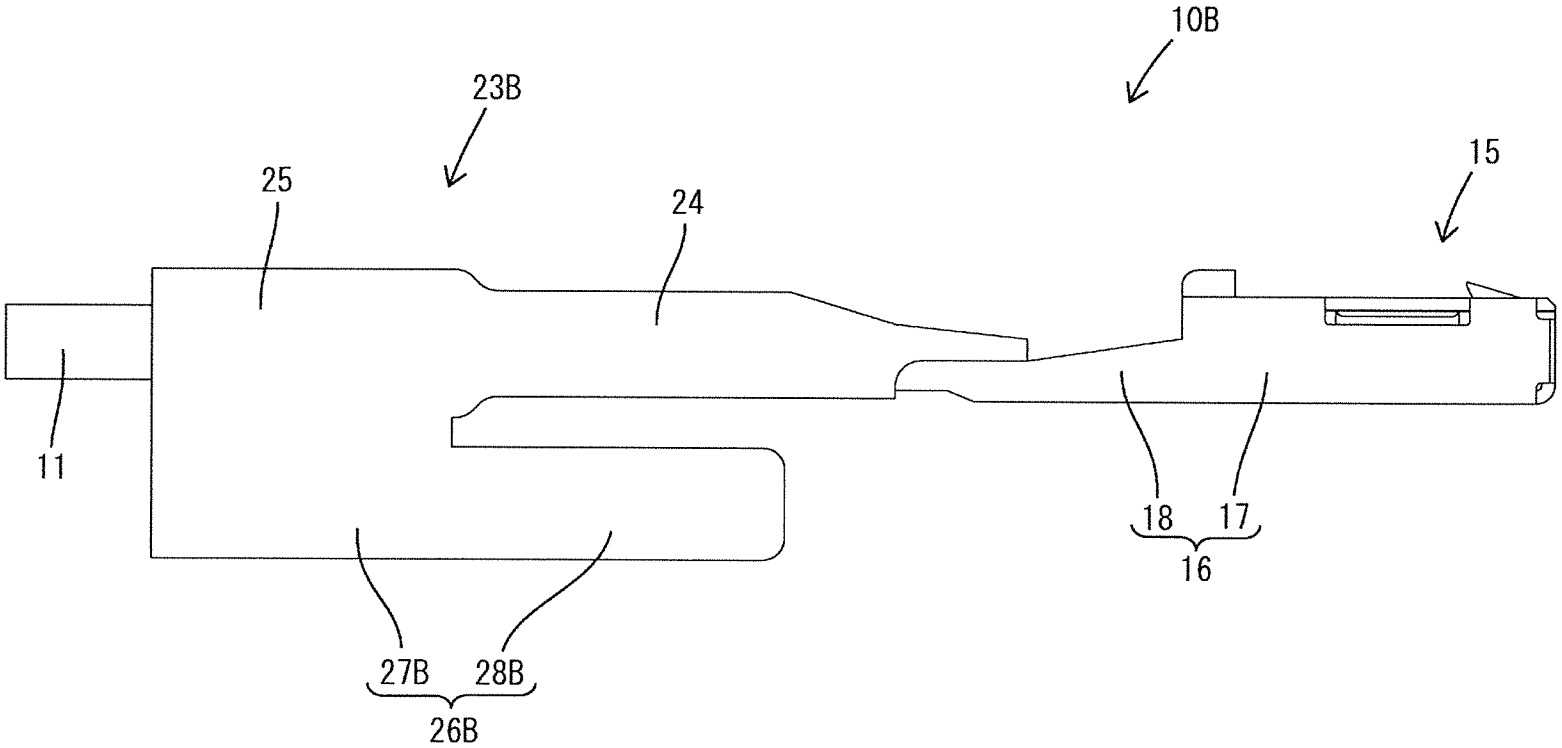
FIG. 8 is a side view of the second wire with terminal.

As shown in FIGS. 7 and 8, the second contact portion 26B of the second mold 23B constituting the second wire with terminal 10B is composed of a second bulge 27B and a second fitting 28B. The second bulge 27B is in the form of a rib (or wall) protruding down from the lower surface of the projection 25. A formation area of the second bulge 27B in the front-rear direction is a range continuous over the entire length of the projection 25 from a front end to a rear end. The second fitting 28B is cantilevered forward from the front end of the second bulge 27B. A clearance equivalent to a thickness of a partition wall 33 between vertically adjacent terminal accommodation chambers 31 is formed between the second fitting 28B and the lower surface of the accommodating portion 24. The second fitting 28B is molded into a shape to fit into the terminal accommodation chamber 31 without rattling in the vertical direction and the lateral direction.

Figure 12:
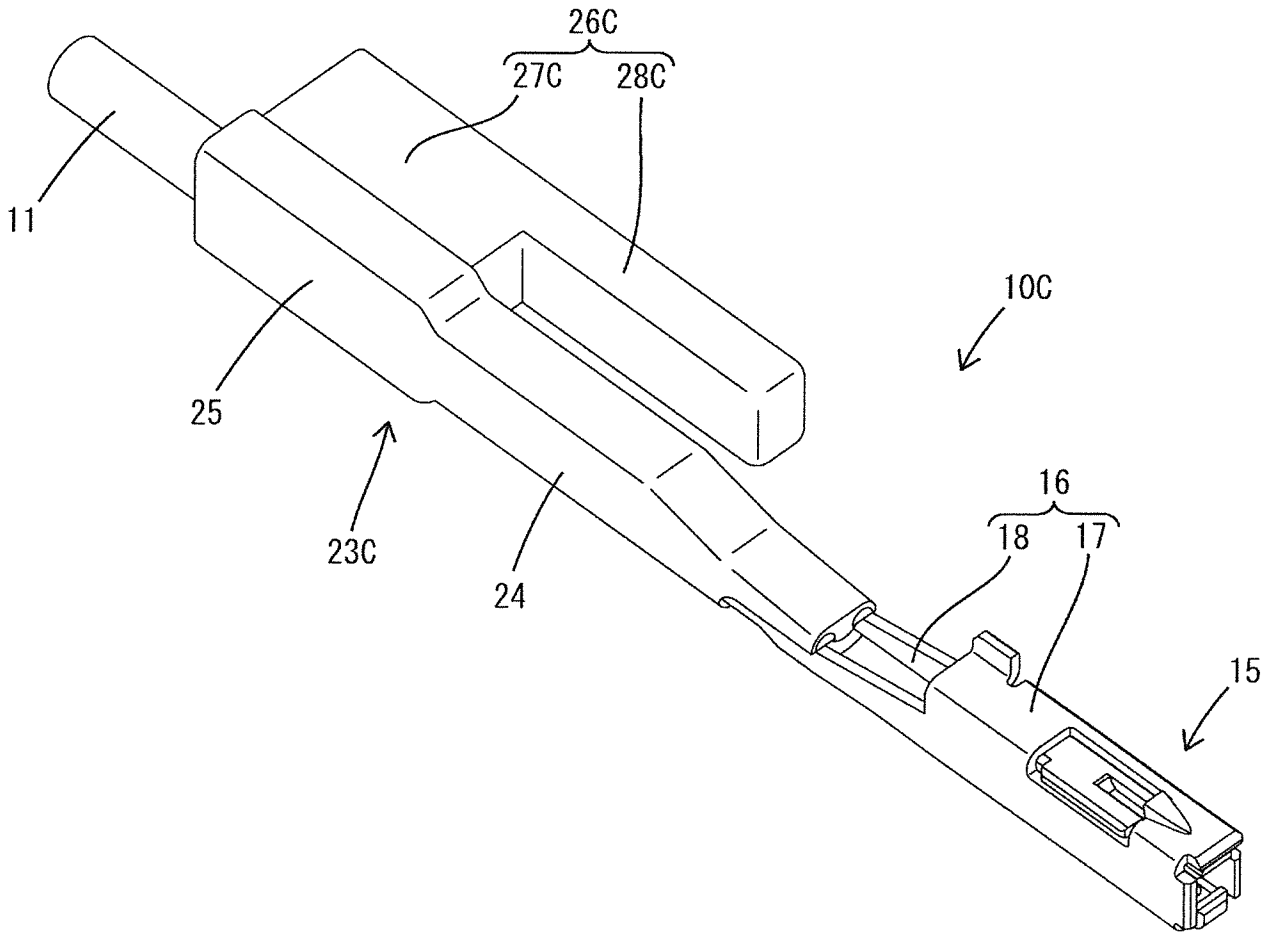
FIG. 12 is a perspective view of the third wire with terminal.
Figure 13:
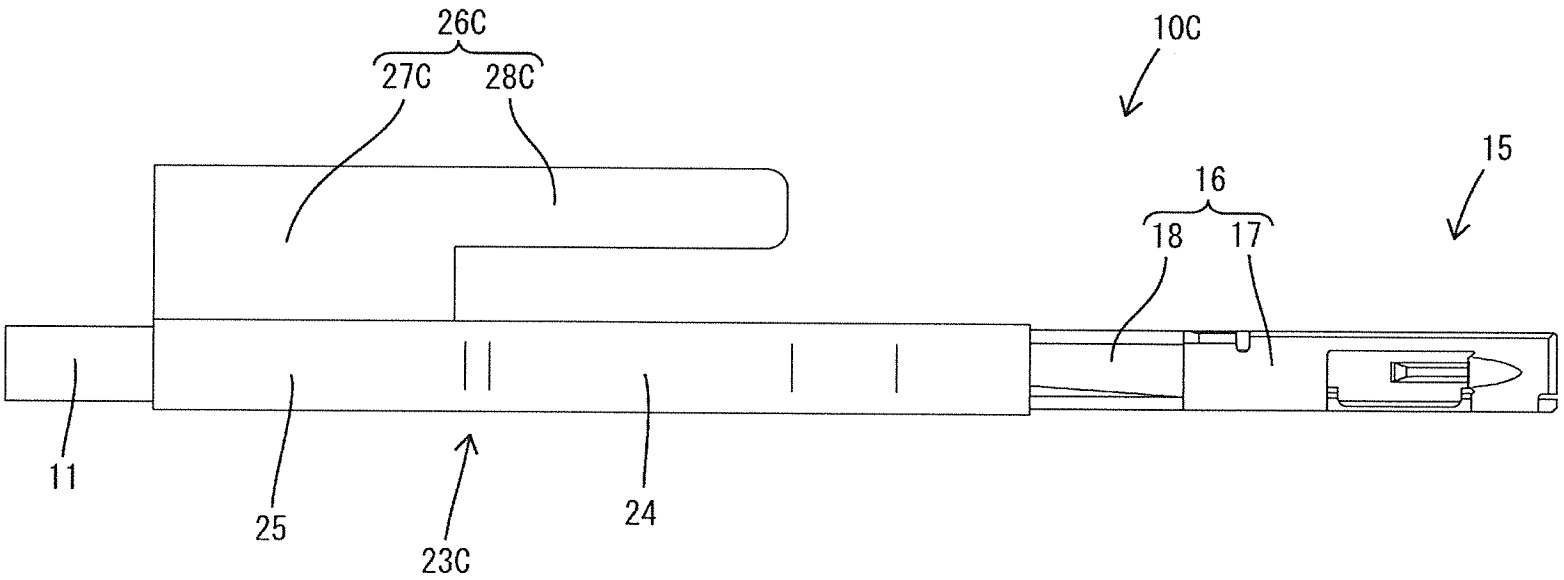
FIG. 13 is a plan view of the third wire with terminal.

As shown in FIGS. 12 and 13, the third contact portion 26C of the third mold 23C constituting the third wire with terminal 10C is composed of a third bulge 27C and an external fitting 28C. The third bulge 27C is in the form of a rib (or wall) protruding leftward from the left side surface of the projection 25. A formation area of the third bulge 27C in the front-rear direction is a range continuous over the entire length of the projection 25 from a front end to a rear end. The external fitting 28C is cantilevered forward from the front end of the third bulge 27C. A clearance equivalent to a thickness of an outer wall 34 defining the terminal accommodation chamber 31 located on an outermost end in the lateral direction and the outer side surface of the housing 30 is formed between the right side surface of the external fitting 28C and the left side surface of the accommodating portion 24.

As described above, the connector of this embodiment includes the housing 30 formed with the terminal accommodation chambers 31 arranged in parallel in the vertical direction and the lateral direction, and the three types of wires with terminals 10A, 10B and 10C to be inserted into the respective terminal accommodation chambers 31. The wire with terminal 10A, 10B, 10C includes the coated wire 11, the terminal fitting 15 and the mold 23A, 23B, 23C. The wire with terminal 10A, 10B, 10C is mounted in a vertically inverted posture into the housing 30. With the wire with terminal 10A, 10B, 10C mounted in the housing 30, the entire terminal fitting 15 and a front area (accommodating portion 24) of the mold 23A, 23B, 23C are accommodated in the terminal accommodation chamber 31.

The coated wire 11 includes the core 12 and the insulation coating 13 surrounding the core 12, and the core 12 is exposed in the front end part of the coated wire 11. The barrel 19 is formed in the rear part of the terminal fitting 15 and is crimped to surround the exposed area 14 of the core 12 (i.e. front end part of the coated wire 11) without contacting the insulation coating 13.

The mold 23A, 23B, 23C covers the entire terminal fitting 15 and the front part of the coated wire 11 including the crimped part to the barrel 19 in a liquid-tight manner. Specifically, the mold 23A, 23B, 23C covers the entire exposed area 14 of the core 12 including the crimped part to the barrel 19 and the front part of the insulation coating 13 in a liquid-tight manner. The core 12 is made of aluminum or aluminum alloy, whereas the terminal fitting 15 is made of copper or copper alloy. Thus, a contact part of the core 12 and the terminal fitting 15 (barrel 19) is surrounded in a liquid-tight manner by the mold 23A, 23B, 23C made of synthetic resin as an anti-corrosion means in the contact part of the core 12 and the terminal fitting 15 (barrel 19).

An outer diameter of the insulation coating 13 is larger than that of the core 12. Thus, an outer diameter of the area (projection 25) of the mold 23A, 23B, 23C surrounding the insulation coating 13 is larger than that of the area (accommodating portion 24) of the mold 23A, 23B, 23C surrounding the core 12. In view of this point, an insulation barrel to be crimped to surround the insulation coating 13 is not formed in the rear end part of the terminal fitting 15 constituting the wire with terminal 10A, 10B, 10C of this embodiment. Thus, the entire area of the mold 23A, 23B, 23C surrounding the terminal fitting 15 can be accommodated in the terminal accommodation chamber 31 without enlarging the volume (height and width) of the terminal accommodation chamber 31.

The insulation barrel not formed in the terminal fitting 15 of this embodiment has a bending suppressing function of suppressing the influence of bending of the coated wire 11 outside the housing 30 on the crimped part of the terminal fitting 15 and the core 12. Thus, the mold 23A, 23B, 23C of this embodiment is required to have a waterproof function and also the bending suppressing function instead of the insulation barrel. Accordingly, in the wire with terminal 10A, 10B, 10C of this embodiment, the projection 25 is provided with the contact portion 26A, 26B, 26C for suppressing the deformation of the projecting portion 25 of the mold 23A, 23B, 23C projecting out from the housing 30.

Figure 1:
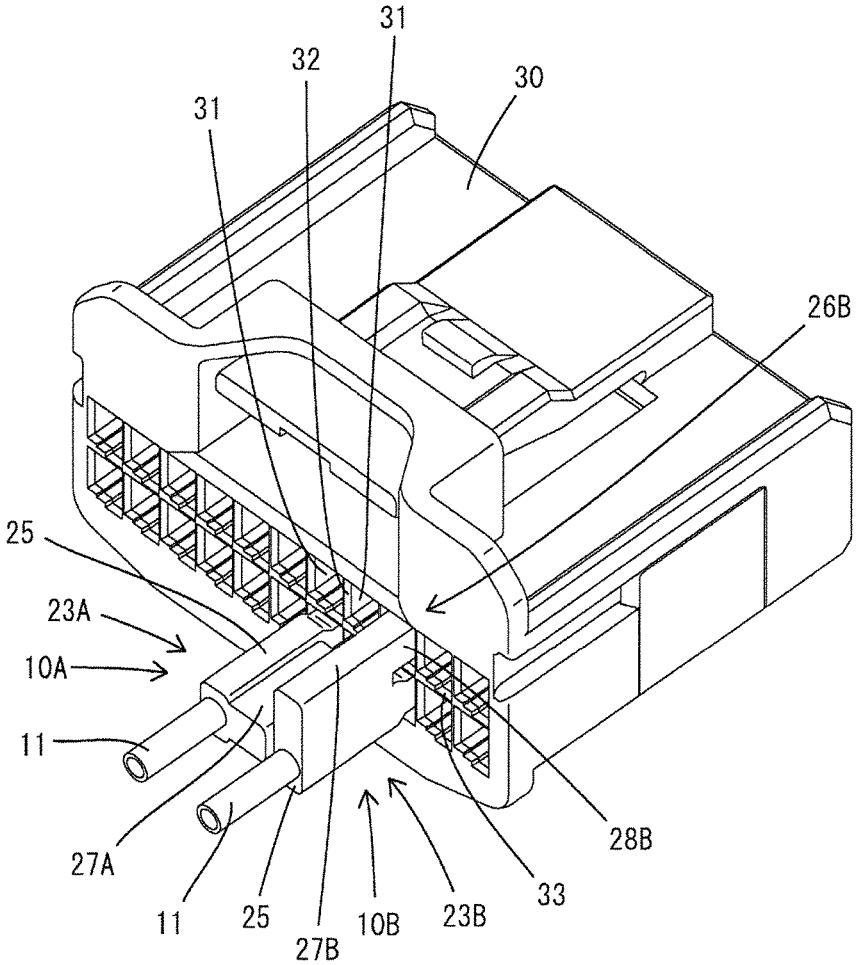
FIG. 1 is a perspective view showing a state where a first wire with terminal and a second wire with terminal are mounted in a housing in a connector of an embodiment.
Figure 2:
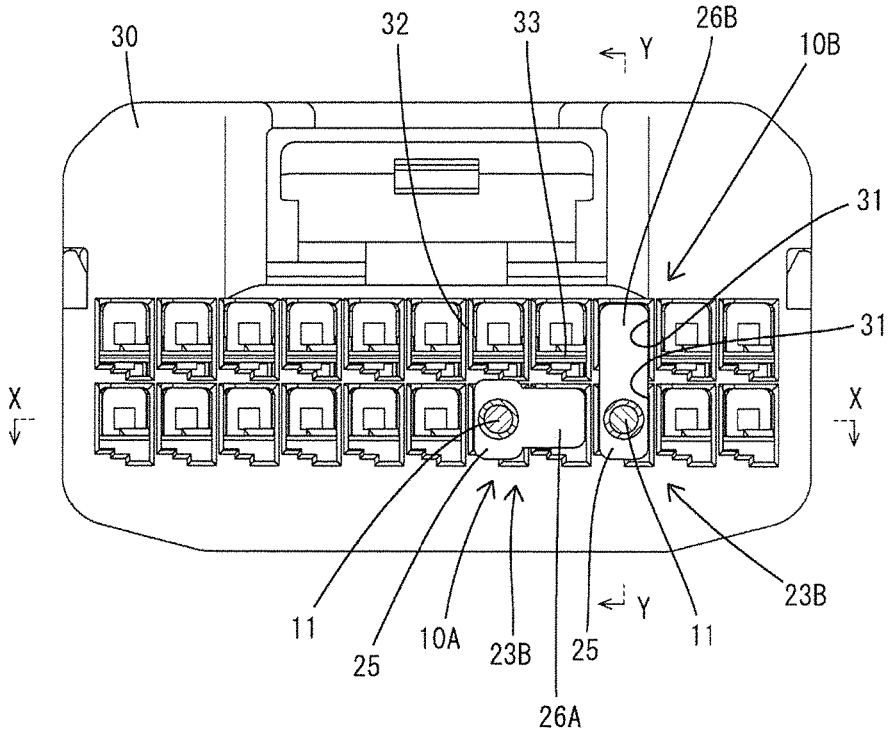
FIG. 2 is a back view showing the state where the first wire with terminal and the second wire with terminal are mounted in the housing.

Specifically, as shown in FIGS. 1 and 2, the terminal fitting 15 of the first wire with terminal 10A is inserted into the terminal accommodation chamber 31 located immediately on the left side of the empty terminal accommodation chamber 31 where none of the wires with terminals 10A, 10B and 10C is inserted. When the first wire with terminal 10A is inserted into the terminal accommodation chamber 31, the first fitting 28A is fit into the empty terminal accommodation chamber 31 immediately on the right side with rattling in the vertical direction and the lateral direction restricted. By this fitting of the first fitting 28A, the deformation of the projection 25 connected to the first fitting 28A is suppressed even if the coated wire 11 is bent in the vertical or lateral direction.

Further, as shown in FIGS. 1 and 2, the terminal fitting 15 of the second wire with terminal 10B is inserted into the terminal accommodation chamber 31 located immediately below the empty terminal accommodation chamber 31 where none of the wires with terminals 10B, 10B and 10C is inserted. When the second wire with terminal 10B is inserted into the terminal accommodation chamber 31, the second fitting 28B is fit into the immediately above empty terminal accommodation chamber 31 with rattling in the vertical direction and the lateral direction restricted. Thus, the deformation of the projection 25 connected to the second fitting 28B is suppressed even if the coated wire 11 is bent in the vertical or lateral direction.

Figure 9:
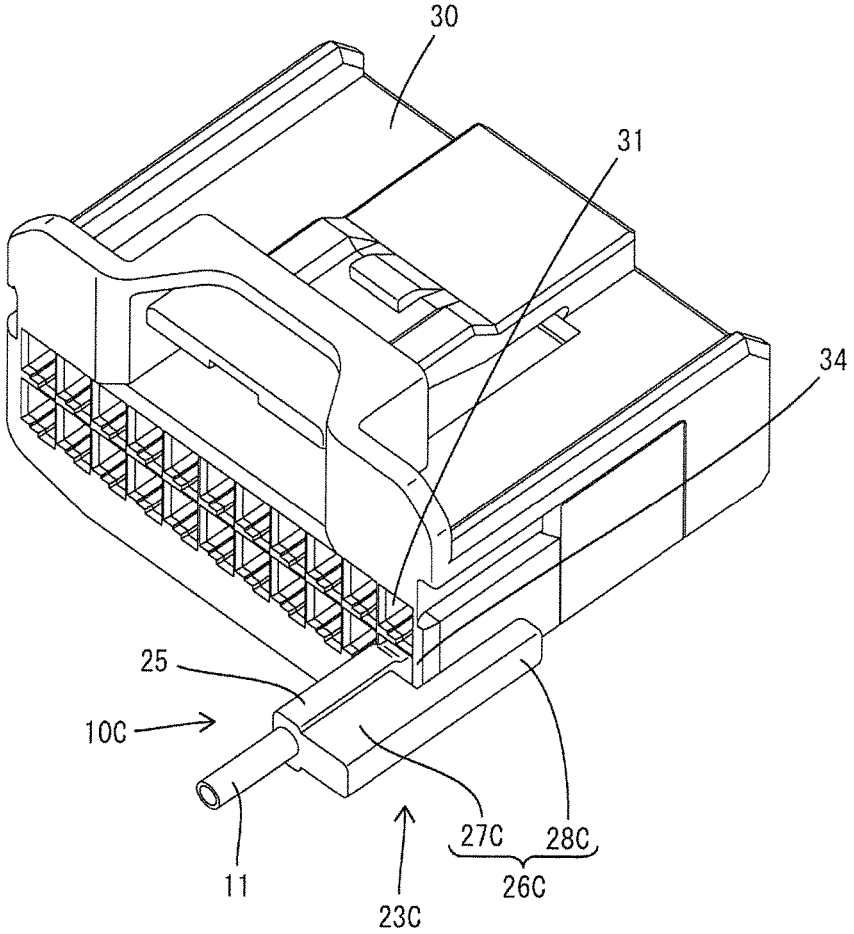
FIG. 9 is a perspective view showing a state where a third wire with terminal is mounted in the housing.
Figure 10:
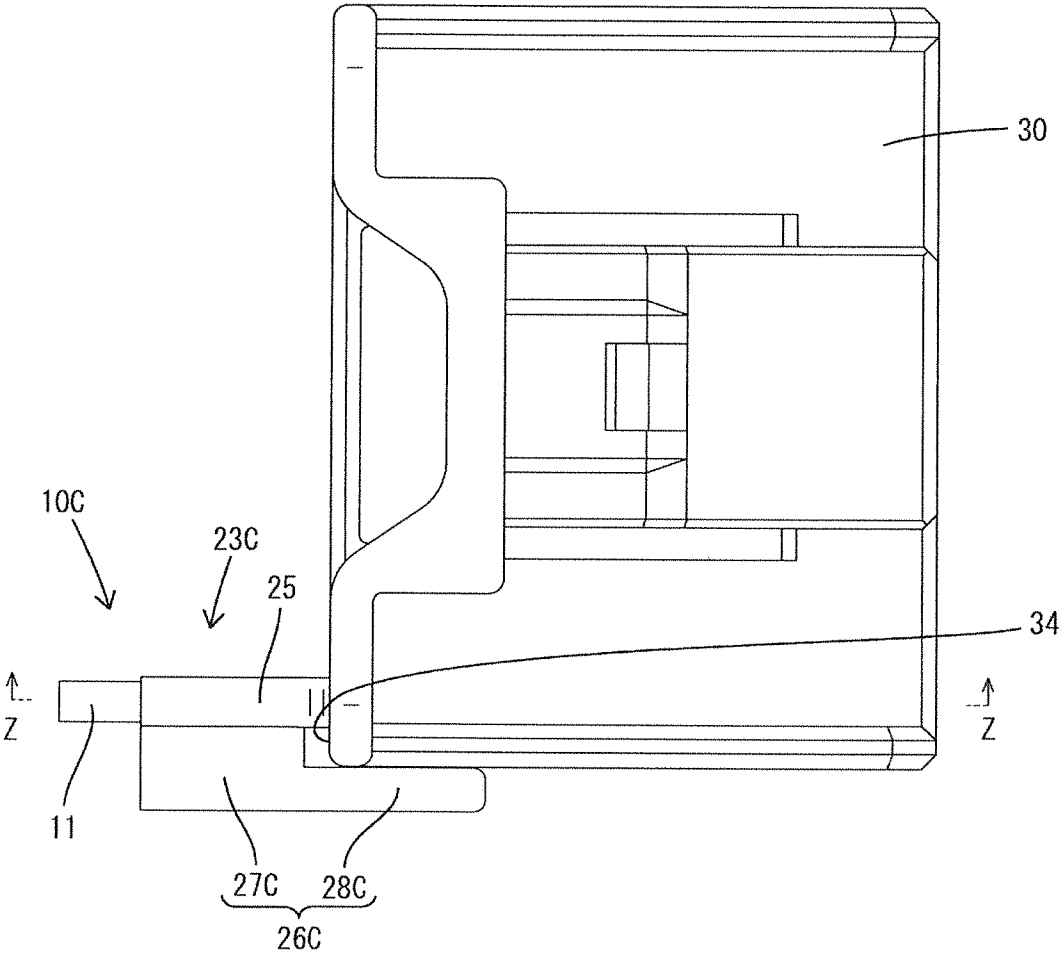
FIG. 10 is a plan view showing the state where the third wire with terminal is mounted in the housing.

Further, as shown in FIG. 9, the terminal fitting 15 of the third wire with terminal 10C is inserted into the terminal accommodation chamber 31 located on the outermost end in the lateral direction. When the third wire with terminal 10C is inserted into the terminal accommodation chamber 31, the external fitting 28C comes into surface contact with an outer surface of the outer wall 34 of the housing 30. That is, the external fitting 28C and the projection 25 connected to this external fitting 28C sandwich the outer wall 34 of the housing 30 in the lateral direction. By this sandwiching, the deformation of the projecting portion 25 connected to the external fitting 28C is suppressed even if the coated wire 11 is bent in the vertical or lateral direction.

As described above, in the connector of this embodiment, the deformation of the projection 25 of the mold 23A, 23B, 23C projecting out from the housing 30 can be suppressed by bringing any one of the first to third contacts 26A, 26B and 26C formed in the molds 23A, 23B and 23C into contact with the housing 30. By bringing the contact 26A, 26B, 26C of the mold 23A, 23B, 23C into contact with the housing 30 in this way, the projection 25 of the mold 23A, 23B, 23C is less likely to be deformed. Thus, the core 12 and the terminal fitting 15 are held stably held in contact in the barrel 19.

Further, since the first fitting 28A constituting the first contact portion 26A and the second fitting 28B constituting the second contact portion 26B come into contact with the inner walls of the empty terminal accommodation chambers 31 where the terminal fitting 15 is not accommodated, bending rigidity of the first and second molds 23A, 23B (projections 25) can be enhanced even without changing the shape of the housing 30 (terminal accommodation chambers 31). Further, since the external fitting 28C constituting the third contact 26C comes into contact with the outer surface of the housing 30, bending rigidity of the third mold 23C (projection 25) can be enhanced even without changing or complicating the outer surface shape of the housing 30.

The invention is not limited to the above described and illustrated embodiment. For example, the following embodiments also are included in the scope of the invention.

Although the core of the coated wire is made of aluminum or aluminum alloy in the above embodiment, the material of the core is not limited to aluminum or aluminum alloy and may be another metal such as copper or copper alloy.

Although the terminal fitting is made of copper or copper alloy in the above embodiment, the material of the terminal fitting is not limited to copper or copper alloy and may be another metal such as aluminum or aluminum alloy.

Although the terminal fitting is not formed with the insulation barrel to be crimped to the insulation coating in the above embodiment, the invention can be applied also when the terminal fitting is formed with the insulation barrel.

Although the front end part of the insulation coating of the coated wire is accommodated in the terminal accommodation chamber in the above embodiment, the front end part of the insulation coating of the coated wire may not be accommodated in the terminal accommodation chamber. According to this configuration, the mold portion can be accommodated in the terminal accommodating chamber even without enlarging the volume of the terminal accommodating chamber.

List of Reference Signs

| | | |
|---|---|---|
| 11 | . . . | coated wire |
| 12 | . . . | core |
| 13 | . . . | insulation coating |
| 14 | . . . | exposed area of core |
| 15 | . . . | terminal fitting |
| 19 | . . . | barrel |

-continued

| List of Reference Signs | | |
|---|---|---|
| 23A | . . . | first mold |
| 23B | . . . | second mold |
| 23C | . . . | third mold |
| 25 | . . . | projection of mold portion |
| 26A | . . . | first contact |
| 26B | . . . | second contact |
| 26C | . . . | third contact |
| 30 | . . . | housing |
| 31 | . . . | terminal accommodation chamber |

The invention claimed is:

1. A connector, comprising:

a coated wire including a core and an insulation coating surrounding the core, the core being exposed in a front part of the wire;

a terminal fitting;

a barrel formed in a rear part of the terminal fitting, the barrel being crimped to surround the front part of the coated wire;

a mold covering the front part of the coated wire in a liquid-tight manner including a part of the coated wire having the barrel crimped thereto;

a housing formed with a terminal accommodation chamber for accommodating the entire terminal fitting and a front area of the mold; and a contact portion formed in the mold, the contact portion being configured to suppress deformation of a projection of the mold projecting out from the housing by coming into contact with the housing.

2. The connector of claim 1, wherein:

the housing is formed with a plurality of the terminal accommodating chambers arranged in parallel; and the contact portion is in contact with an inner wall of the terminal accommodating chamber where the terminal fitting is not accommodated.

3. The connector of claim 1, wherein the contact portion is in contact with an outer surface of the housing.

* * * * *